United States Patent [19]

Maihos

[11] Patent Number: 4,600,133

[45] Date of Patent: Jul. 15, 1986

[54] FOLDABLE KNIFE HOLDER

[76] Inventor: Michael G. Maihos, 43 Nichols St., Danvers, Mass. 01923

[21] Appl. No.: 710,553

[22] Filed: Mar. 11, 1985

[51] Int. Cl.[4] ..... B26B 29/02

[52] U.S. Cl. ..... 224/232; 224/253

[58] Field of Search ..... 30/151, 152, 153, 154, 30/155, 156, 157; 224/253, 163, 232, 911, 904

[56] References Cited

U.S. PATENT DOCUMENTS

| | | | |
|---|---|---|---|
| 4,466,561 | 8/1984 | Slaughter | 224/163 |
| 4,494,309 | 1/1985 | Gray | 224/232 X |
| 4,494,310 | 1/1985 | Slaughter | 30/155 |

*Primary Examiner*—Stephen Marcus
*Assistant Examiner*—David Voorhees
*Attorney, Agent, or Firm*—Thomas C. Stover, Jr.

[57] ABSTRACT

A holder or holster for a foldable knife in which the knife has a handle and a blade pivotably mounted to the handle is provided. The holster has a cam-fulcrum therein which bridges a forward portion thereof proximate the exit for the handle of the knife. The holster has a chamber therein to receive and hold the knife in a partially-folded position around the cam-fulcrum so that on withdrawal of the knife, the blade contacts and pivots around the cam-fulcrum and opens relative to the handle so that the knife is withdrawn from the holster in an open position.

The holster can also have a second cam-fulcrum which bridges a rearward portion thereof so that on insertion of the knife into the holster, the back edge of the blade contacts such cam-fulcrum and is folded toward the handle as the handle advances into the holster.

Accordingly, the foldable knife is automatically opened upon withdrawal from the holster and automatically folded upon insertion therein.

In addition, a rear opening can be provided in the holster to permit withdrawal of the knife from the back of the holster in a folded or closed position.

13 Claims, 4 Drawing Figures

FOLDABLE KNIFE HOLDER

BACKGROUND OF THE INVENTION

1. Field of the Invention

This invention relates to a holster for a knife, particularly a holster for a foldable knife.

2. The Prior Art

A number of holsters or sheathes have been proposed for various knives, including straight knives such as U.S. Pat. No. 2,387,900 to Hartwell (1944) and U.S. Pat. No. 2,859,516 to McQueary (1957), which relate to carrying and removal of straight or unfolded knives from a sheath worn on a belt. There has also been proposed a carrying means for a foldable knife in which such knife is folded into and forms part of a belt buckle as disclosed in U.S. Pat. No. 4,466,561 (1984). This knife is specially made for the belt buckle and cannot be removed therefrom without first depressing a lever to disengage a locking mechanism and then pivoting the handle upwardly until it engages the blade in an open position, upon which the knife is removed from the belt buckle.

None of the prior art references provide a holster for foldable knives which can be removed therefrom without pressing a lever and then manually pivoting the handle thereof into engagement with its blade in a two-step process before or during the withdrawal step, and there is a need and market for a foldable knife holster that overcomes the above prior art shortcomings.

There has now been discovered a holster for a foldable knife that provides for quick unfolding and release of the so unfolded knife in one step, as well as for storage and carrying of such knife in a folded and secure position.

SUMMARY

Broadly the present invention provides a holster for a foldable knife, the knife having a handle and a blade pivotably mounted to the handle, comprising a holster having a cam-fulcrum therein which bridges a forward portion of the holster proximate the exit for the handle of the knife, the holster having a chamber therein to receive and hold the knife in a partially-folded position around the cam-fulcrum, such that on withdrawal of the knife from the holster, the blade contacts and pivots around the cam-fulcrum and opens relative to the handle, so that the knife is withdrawn from the holster in an open position.

BRIEF DESCRIPTION OF THE INVENTION

The invention will become more apparent from the following detailed specification and drawings in which.

PREFERRED EMBODIMENT OF THE INVENTION

Figure 1:
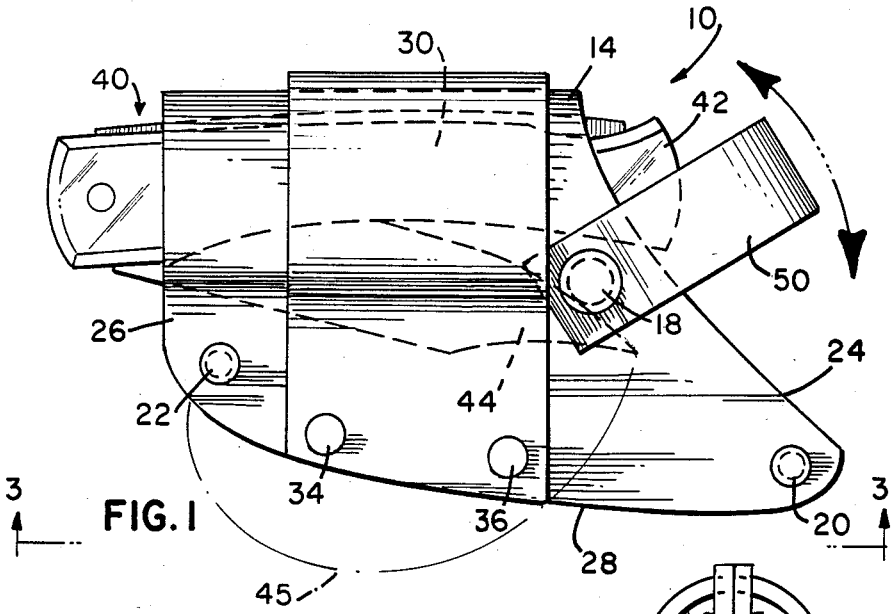
FIG. 1 is a side elevation view of the holster embodying the present invention.
Figure 2:
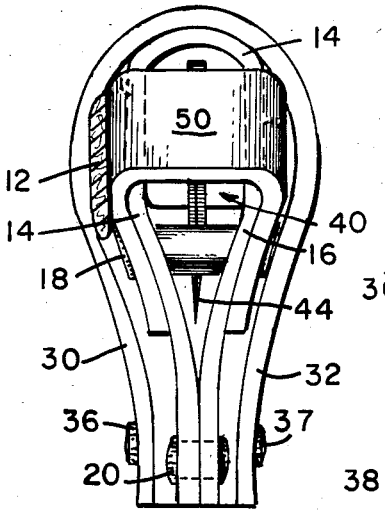
FIG. 2 is an end elevation view of the holster shown in FIG. 1.
Figure 3:
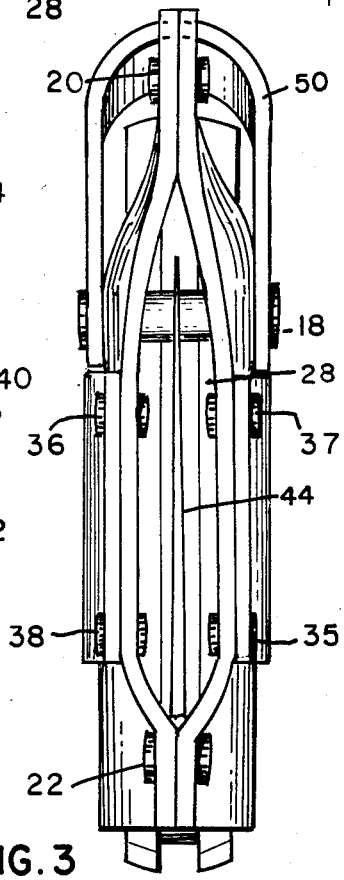
FIG. 3 is a bottom plan view of the holster shown in FIGS. 1 and 2.

Referring in more detail to the drawings, foldable knife holster or carrier 10, wearable on a belt 12, is shown as an envelope having walls 14 and 16, held together by rivets 18, 20 and 22, as shown in FIGS. 1 and 2, but which is open at the ends 24 and 26, as indicated in FIG. 1 and open at the bottom 28, as shown or indicated in FIGS. 1 and 3.

A belt loop having segments 30 and 32 extends over the carrier walls and is attached thereto by rivets 34, 35, 36 and 37, as shown or indicated in FIGS. 3 and 1.

A foldable knife 40 having a handle 42 and a pivotable blade 44 is inserted into the carrier 10 in a partially open position around rivet 18, which extends through the holster walls 14 and 16 and acts as a cam-fulcrum for the blade 44 as the foldable knife 40 is withdrawn from the carrier 10, as shown or indicated in FIGS. 1 and 2.

Figure 4:
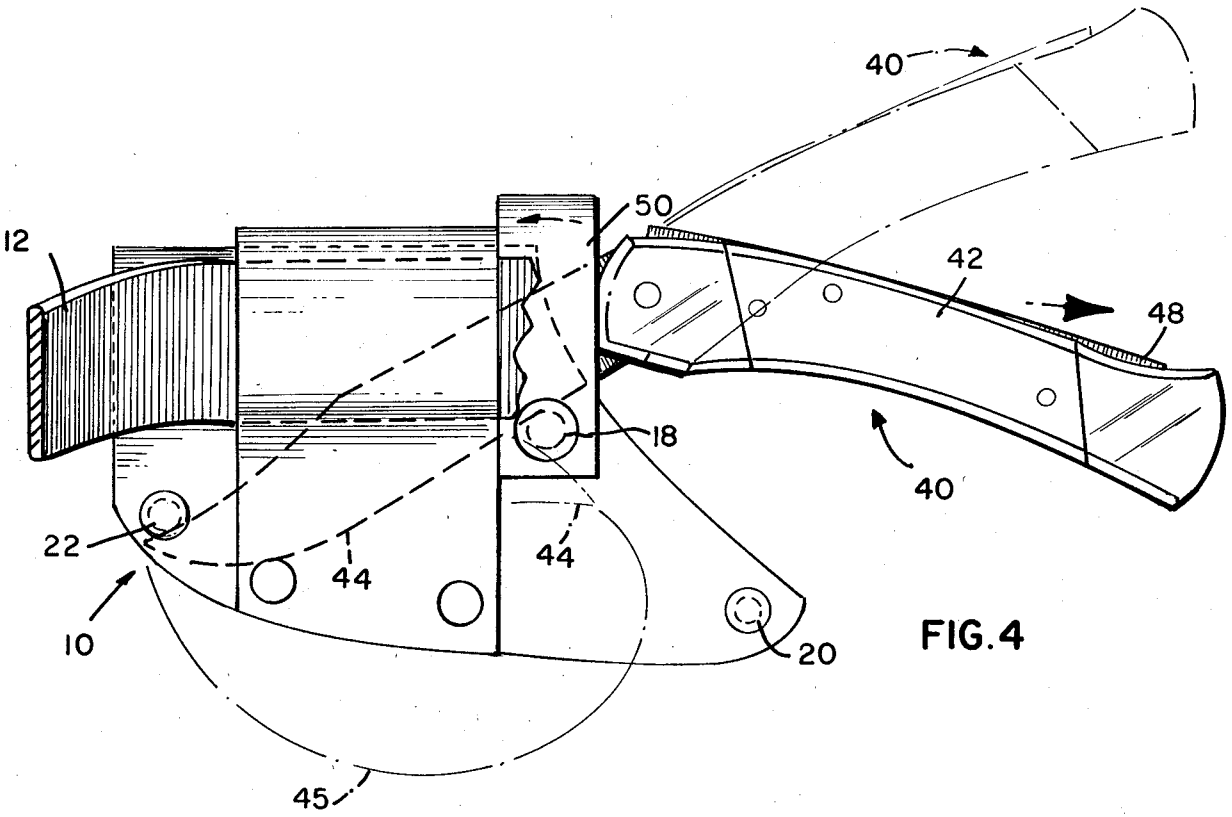
FIG. 4 is a side elevation view of the holster embodying the invention during transitional use thereof.

In operation, when the wearer grasps the folded knife handle 42 and pulls it from the carrier 10, the blade 44 pivots on the rivet 18 and swings open along the dotted arc 45, so that the folded knife 40 quickly snaps open and is pulled from the carrier 10, as shown or indicated in FIGS. 1 and 4 (in phantom).

In the reverse operation, detent lever 48 of the knife 40 is depressed, the knife partially folded, as shown in FIG. 4, and reinserted to the holster 10 with the back of the blade 44 advancing inside the rivet 22, which acts as a second cam-fulcrum and causes the blade 44 to fold toward the handle 42 as the latter is advanced into the holster 10, as indicated in FIG. 4, until the knife 40 is again folded within the holster 10, as shown in FIG. 1.

Typically the blade 44 is spring-loaded and closes toward the handle until it contacts the cam-fulcrum 18, as shown in FIG. 1.

A safety loop 50 is pivoted from the open position shown in FIG. 4 to a closed position, shown in FIG. 1, to secure the knife in the holster, as indicated in FIG. 1.

Thus, a foldable knife, including a jackknife, is securely carried in a holster or carrier, yet is converted to a quick-draw implement by the holster embodying the present invention.

Unlike the prior art, the holster of the invention of a given size can carry different sized folding knives. Further, the holster of the invention can itself be of different sizes, including shallow and open at the bottom, e.g. as shown in FIG. 1, to permit a pivoting blade to extend therebelow or can be of a deeper size and open or closed at the bottom, such that the pivoting blade does not extend therebelow, as desired, within the scope of the invention.

The holster of the invention advantageously contains an attachment means for a belt, strap or harness. Desirably, a loop is provided that is attached to the holster of the invention through which a belt or strap can pass. Preferred, however, is a holster having belt attachement means on either side thereof, including the pair of belt passages shown, e.g. in FIG. 2 of the drawing, so that the holster may be worn on either side to accommodate the left or right-handed wearer.

While the cam-fulcrums disclosed herein can be rivets mounted in the holster, they can also be screws, pins or other pivot guides or cam means within the scope of the invention.

Further, the cam-fulcrum mounted in the rearward portion of the holster, that which helps fold the knife as it is inserted therein, can be omitted from the holster of the invention and the knife folded by hand, upon insertion, if desired, within the scope of the invention. Preferably, however, the holster of the invention contains both forward and rearward cam-fulcrums for the purposes discussed at length above.

The holster of the present invention can be made of various materials, e.g. leather, cloth, plastic or other materials. Preferably, however, the holster of the invention is made of leather.

Further, while the safety strap or loop which secures the knife in the holster can be omitted within the scope of the invention, it is retained in the preferred holster embodying the invention.

In addition, the foldable knife of the invention can be withdrawn by pushing (or pulling) it through the back opening 26, so it is safely withdrawn in the folded or closed position.

What is claimed is:

1. A holster for a foldable knife, said knife having a handle and a blade pivotably mounted to said handle, comprising a holster having a cam-fulcrum therein which bridges a forward portion of said holster proximate the exit for the handle of said knife, said holster having a chamber therein to receive and hold said knife in a partially-folded position around said cam-fulcrum, such that on withdrawal of said knife from said holster, said blade contacts and pivots around said cam-fulcrum and opens relative to said handle, so that said knife is withdrawn from said holster in an open position.

2. The holster of claim 1 being open at the bottom thereof below said cam-fulcrum to permit pivoting of said blade partially through said opening as said knife opens on withdrawal from said holster.

3. The holster of claim 1 wherein said chambers, are defined by two sides thereof, which are bridged by a rivet which serves as said barrier-fulcrum.

4. The holster of claim 3 wherein another rivet joins said two sides together and terminates the pivot of said blade as it swings to the open position on withdrawal from said holster.

5. The holster of claim 1, having a belt loop mounted thereon, so that said holster and knife can be mounted on a belt of the wearer.

6. The holster of claim 5 in which said belt loop extends on both sides of said holster so that the holster may be worn on a belt on either side of the wearer.

7. The holster of claim 6 wherein the holster and the belt loop are made of leather.

8. The holster of claim 1, wherein said holster additionally has a pivotable strap, which defines an arc around the knife handle when it is positioned in said holster to hold the knife within said holster, yet pivots out of the way to permit withdrawal of said knife from said holster.

9. The holster of claim 8, wherein said holster is formed of a continuous piece that is folded over in a loop and joins proximate the ends thereof, and said belt loop is likewise formed of a continuous piece that is folded over said holster and outside thereof and joined proximate the ends thereof.

10. The holster of claim 1 having a second cam-fulcrum which bridges a rearward portion of said holster to contact the back edge of said blade, such that upon insertion of the knife into said holster, the back edge of said blade contacts said cam-fulcrum and is folded toward said handle as said handle advances into said holster, so that said knife is at least partially folded upon insertion into said holder.

11. The holster of claim 10 wherein said second cam-fulcrum is a rivet which joins two sides of said holster and which rivet terminates the pivot of said blade as it swings to the open position on withdrawal from said holster.

12. The holster of claim 1 having a rearward opening therein such that said knife can be removed therefrom in a folded or closed position.

13. A foldable knife and holster, in combination comprising, a knife having a handle and a blade pivotably mounted to said handle, a holster having a cam-fulcrum therein which bridges a forward portion of said holster proximate the exit for the handle of said knife, said holster having a chamber therein to receive and hold said knife in a partially-folded position around said cam-fulcrum, such that on withdrawal of said knife from said holster, said blade contacts and pivots around said cam-fulcrum and opens relative to said handle, so that said knife is withdrawn from said holster in an open position.

* * * * *